United States Patent [19]

Feldmann

[11] Patent Number: 4,970,960

[45] Date of Patent: Nov. 20, 1990

[54] ANTI-MATERIAL PROJECTILE

[76] Inventor: Fritz K. Feldmann, 460 Ward Dr., Ste. E, Santa Barbara, Calif. 93111

[21] Appl. No.: 423,651

[22] Filed: Oct. 18, 1989

Related U.S. Application Data

[63] Continuation of Ser. No. 281,907, Dec. 6, 1988, abandoned, which is a continuation of Ser. No. 37,092, Apr. 10, 1987, abandoned, which is a continuation-in-part of Ser. No. 775,482, Sep. 12, 1985, abandoned, which is a continuation of Ser. No. 460,965, Jan. 25, 1983, abandoned, which is a continuation of Ser. No. 201,871, Nov. 5, 1980, abandoned.

[51] Int. Cl.[5] ..... F42G 10/00

[52] U.S. Cl. ..... 102/506; 89/1.11; 75/248; 102/491; 102/501; 102/517; 102/518; 102/519; 102/520

[58] Field of Search ..... 89/1.11; 102/491, 501, 102/506, 507, 517, 518, 519, 520; 75/248

[56] References Cited

U.S. PATENT DOCUMENTS

| | | | |
|---|---|---|---|
| 3,203,349 | 8/1965 | Schonberg . | |
| 3,302,570 | 2/1967 | Maiquardt | 102/519 |
| 3,370,535 | 2/1968 | Permutter | 102/518 |
| 3,393,056 | 7/1968 | Zdanuk et al. | 428/569 |
| 3,440,043 | 4/1969 | Zdanuk et al. | 428/569 |
| 3,599,573 | 8/1971 | Sliney | 102/517 |
| 3,714,900 | 2/1973 | Feldmann | 102/523 |
| 3,750,585 | 8/1973 | Feldmann | 102/513 |
| 3,786,760 | 6/1974 | Feldmann | 102/527 |
| 3,888,636 | 6/1975 | Sczerzenie et al. | 75/248 |
| 3,941,057 | 3/1976 | Peterson et al. | 102/518 |
| 3,946,673 | 3/1976 | Hayes | 102/517 |
| 3,979,234 | 9/1976 | Northcutt, Jr. et al. | 419/28 |
| 4,056,060 | 11/1977 | Devine | 102/518 |
| 4,108,072 | 8/1978 | Trinks et al. | 102/518 |
| 4,437,409 | 3/1984 | Freymond | 102/364 |
| 4,458,599 | 7/1984 | Mullerdore et al. | 102/517 |
| 4,498,395 | 2/1985 | Kock et al. | 102/517 |

FOREIGN PATENT DOCUMENTS

| | | |
|---|---|---|
| 1009508 | 5/1977 | Canada . |
| 51375 | 5/1982 | European Pat. Off. . |
| 538268 | 7/1941 | United Kingdom . |
| 1205167 | 9/1970 | United Kingdom . |
| 1514908 | 6/1978 | United Kingdom . |
| 1533697 | 12/1978 | United Kingdom . |
| 2021739 | 12/1979 | United Kingdom . |

*Primary Examiner*—Stephen J. Lechert, Jr.
*Attorney, Agent, or Firm*—John N. Bain; Raymond J. Lillie

[57] ABSTRACT

An anti-material projectile of trangible alloy for fragmenting due to impact shock on hitting a target thereafter penetrating the target causing damage. The projectile is preferably high density frangible alloy having a ratio of compressive to tensile strength of 20 to 1. The projectile is useful against soft targets suct as aircraft as well as armor targets where initial impact is at the armor plating. The projectile may be a composite of pyrophoric windscreen with a projectile body of frangible alloy and armor piercing alloy.

17 Claims, 4 Drawing Sheets

12
14
16
18
20
22

24
25
26
27
28
29

24
25
26
27
28
29

41
42
44
46

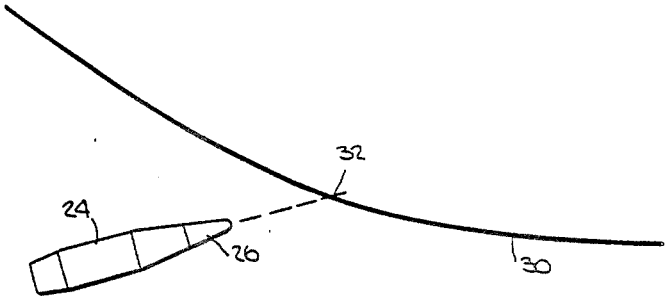
Fig. 5.
Fig. 6.
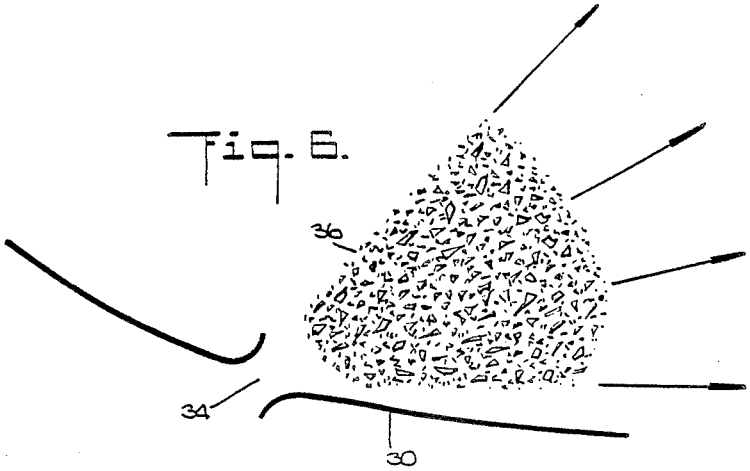

ANTI-MATERIAL PROJECTILE

BACKGROUND OF THE INVENTION

This application is a continuation of Ser. No. 281,907 filed Dec. 6, 1988 which was a continuation of Ser. No. 037,092, filed Apr. 10, 1987 which was a continuation of Ser. No. 775,482, filed Sept. 12, 1985 which was a continuation of Ser. No. 460,965, filed Jan. 25, 1983 which was a continuation of Ser. No. 201,871, filed Nov. 5, 1980 all of which are now abandoned.

Ground-based air defense gun systems of 20 mm and larger calibers presently in service employ conventional high explosive projectiles for defeating a target. Although high explosive projectiles have good terminal effectiveness against aircraft, their inherent exterior ballistic performance is such as to result in poor hit probability in employment against high speed aircraft. High explosive projectiles contain a fuse mechanism and a high explosive filler. These components are rather voluminous and of low weight, thus adversely restricting the sectional density of the projectile. The resultant ballistic coefficient is such as to induce a high degree of velocity decay as a function of range and correspondingly long time of flight. In employment from ground-based guns against low flying, high speed aircraft, the long time of flight requires very large lead angles and superelevation angles. In the case of advanced ground-support aircraft, these angles are of such magnitudes that even with the use of sophisticated fire control systems the resultant hit probabilities are inadequate.

For ground-based gun fire to be effective, ability to hit the target is a prerequisite. To achieve high hit probability performance against fast-flying enemy aircraft, it is essential to fire projectiles having short times of flight resulting from high projectile velocity. In turn, this reduces the lead angle and superelevation angle requirement.

High velocity projectiles with short times of flight are essential for achievement of high hit probabilities regardless of the degree of sophistication of the fire control system. The desired short times of flight can be attained through the use of sabot-launched subcaliber projectiles having a high muzzle velocity as described in my U.S. Pat. No. 3,714,900, "Discarding Sabot Projectiles". Furthermore, in order to minimize velocity loss subsequent to launch, the subcaliber projectiles should have a high sectional density, i.e., should consist of a high density material, such as a tungsten alloy for example, having a density of approximately 16 to 19 g/cm$^3$. These features and related exterior ballistic characteristics are found in advanced discarding-sabot, armor-piercing projectiles described in that patent. However, while providing the desired hit probabilities, the terminal effectiveness of this type of ammunition against aircraft-type targets is unsatisfactory.

Armor-piercing projectiles are of limited terminal effectiveness against soft targets such as high speed aircraft in that the projectile can hit the target causing superficial damage without destroying it.

SUMMARY OF THE INVENTION

In preferred embodiment, this invention is directed to ammunition for ground-based air defense systems in which a high density, frangible alloy used with a discarding-sabot projectile provides the desired terminal ballistics for the destruction of aircraft and similar battlefield targets. According to the invention the subcaliber projectile maintains the exterior ballistic efficiency and related high hit probability characteristics of subcaliber projectiles. In addition, having a terminal effect based solely on the kinetic energy of the projectile, the novel concept eliminates the need for a fuse and high explosive commonly used in air-defense ammunition. Because of its effectiveness against a considerable variety of battlefield targets, including armor, the novel projectile has been named "anti-material projectile".

The novel subcaliber projectile of the discarding-sabot ammunition is preferably spin-stabilized and consists either entirely or predominately of a frangible, high density material. Its operation does not require the provision of either high explosive or a fuse. Upon impact on a target such as an aircraft, the fragmentation of the frangible material is induced by the impact shock wave and the subsequent expansion passing through the projectile body. The resultant fragmentation is nearly uniform throughout the frangible mass. Prenotching or prefragmentation during manufacture is neither required nor desired. The high density fragments are projected into the target in an expanding cluster under the influence of the residual flight velocity and the centrifugal velocity induced by the residual projectile spin. Damage to the aircraft and its components is imparted through impact and/or penetration by high velocity fragments. In the case of aluminum or titanium structures, the impact of the high density, high velocity fragment cluster results in the formation of aluminum or titanium dust and/or vapor. This metalic dust is oxidized explosively and the resulting overpressures and release of heat augment the fragment induced damage.

The damage to the aircraft due to the high speed fragments can be enhanced through the incorporation of pyrophoric metal components in the projectile such as zirconium, titanium, or depleted uranium alloy, which is also fractured and which then ignites due to the impact shock loads. The resultant exothermic reaction, yielding fragments burning at temperatures up to approximately 3000° C., induces pyrophoric effects capable of igniting a variety of combustibles such as gasoline and jet fuel, thereby contributing to the terminal effectiveness of the projectile.

Like conventional projectiles, the frangible projectile can be equipped with a pyrophoric tracer. In one form of the invention the projectile may be provided with a self-destruct mechanism to avoid hazards to friendly personnel, equipment, or installations from projectiles not hitting the target. In this case destruction is timed by the burning of a tracer and is induced by a propellant charge fracturing the frangible projectile body.

For certain applications it may be desirable to employ a projectile body consisting in part of a frangible material and in part of a high strength alloy. Such composite projectiles permit the defeat of spaced multiple plate targets as represented, for example, by aircraft or helicopters equipped with armored cockpits or other protected components.

OBJECTIVES OF THE INVENTION

The objectives of the invention are:

(a). A discarding-sabot projectile consisting of a high density, frangible material having exterior ballistic characteristics resulting in short times of flight and related high hit probabilities and providing the terminal ballistic effectiveness required to defeat aircraft and helicopter-type targets.

(b). The terminal effectiveness of the frangible material is derived entirely from its residual kinetic energy at impact on the target and eliminates the requirement for explosives and a fuse. To realize this objective the frangible material has to have the compressive strength necessary to withstand the very high launch accelerations in the gun tube on the one hand, and to undergo thorough and instantaneous fragmentation upon impact on the thin skin of an aircraft or helicopter-type structure on the other.

(c). The projectile, consisting of the frangible material, has to withstand adverse environmental conditions such as shock, drop, vibration and the like commonly specified for service ammunition.

(d). The frangible material is homogeneous and has mechanical properties such as to undergo spontaneous and thorough fragmentation upon exposure to impact shock wave at the target without the requirement of prenotching or prefragmentating during manufacture.

(e). To induce severe damage to the target components by the impact and/or penetration of the high velocity, high density fragment cluster. Furthermore, in the case of aluminum or titanium target materials, the sudden absorption of the kinetic energy of the impacting fragment cluster results in the release of dust and/or vapor of the respective target materials. The latter is oxidized explosively causing severe overpressure and flashes of fire which are particularly severe in confined areas such as airframes.

(f). To use the frangible material by itself or in combination with a pyrophoric metal component such as zirconium, titanium, depleted uranium or the like. These metals are also fragmented at impact and undergo spontaneous ignition. The resultant incendiary effects contribute to the ignition of fuel and other combustibles contained within the targets.

(g). The successful use of the frangible material projectiles for the defeat of hard armored targets. Because of the fragmentation of the projectile during penetration, its effectiveness behind armor is considerable. This applies specifically in employment against armored personnel carries, infantry fighting vehicles, landing ships, gun boats, and the like.

(h). The provision of a self-destruct device as required for certain air-defense ammunitions.

(i). The provision of a composite projectile enabling the defeat of multiple plate armor targets. The composite projectile consists in part of a high density frangible material and in part of a high strength, high density alloy as commonly used for armor-piercing projectiles.

(j). The provision of a composite projectile comprising a high density frangible alloy main body portion and a high strength alloy base portion for receiving a pyrophoric tracer.

DETAILED DESCRIPTION OF THE INVENTION

A more complete understanding of the invention and of the various embodiments which the invention may take, may be gained from the following illustrative examples and drawings.

FIG. 1 presents a longitudinal sectional view of a typical spinstabilized discarding-sabot subcaliber projectile assembly.

FIG. 5 is a schematic view of a target after being hit by a projectile.

FIG. 6 is a schematic view of a target such as an aircraft having several structural members penetrated by a projectile of the present invention.

Figure 10:
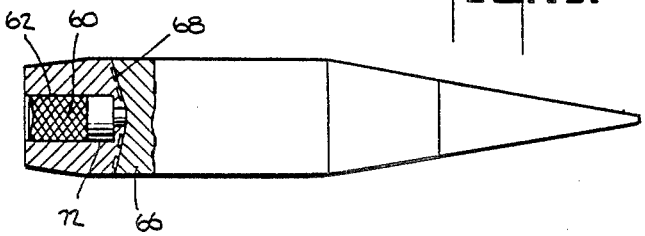

FIG. 10 presents a longitudinal sectional view of a projectile according to the present invention containing a self-destruct device.

Figures 1, 2, 3, 4:
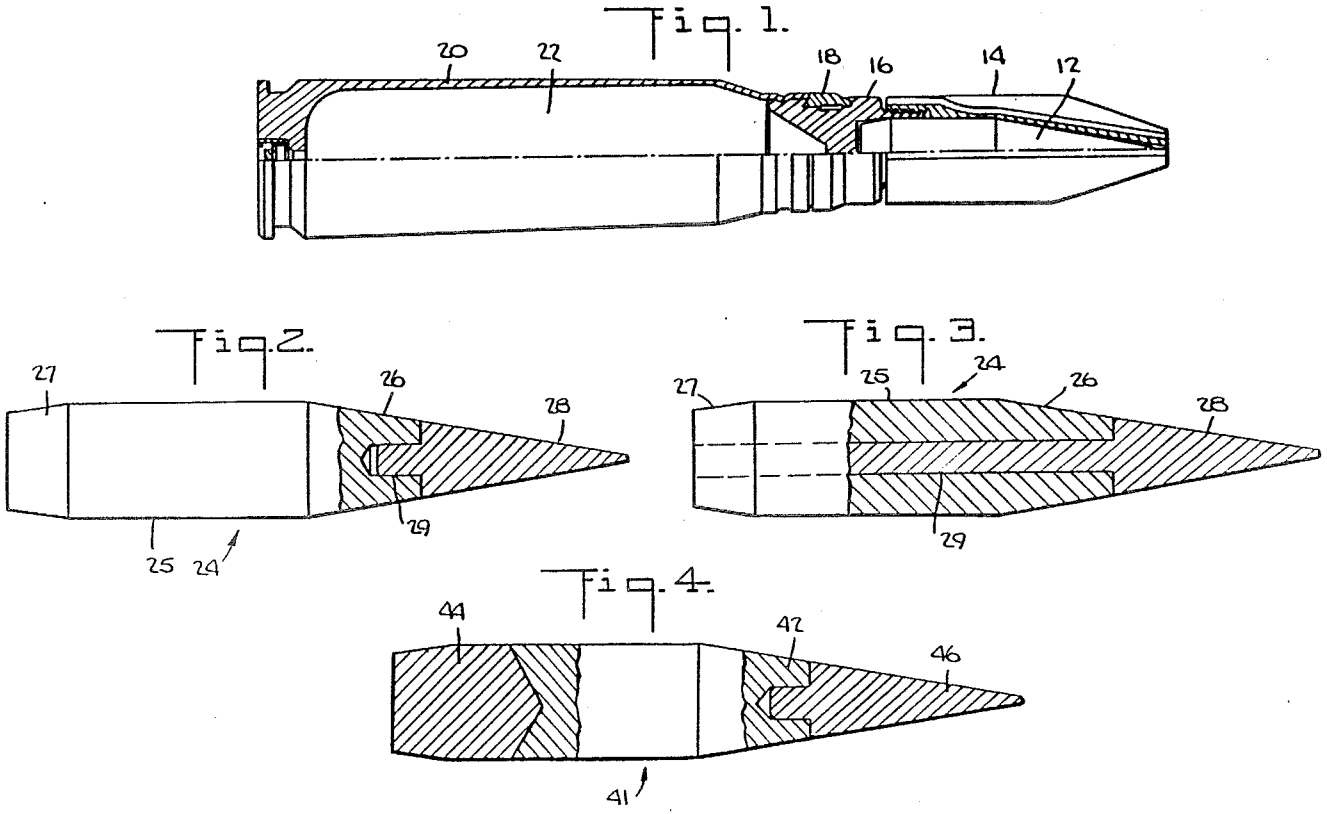
FIG. 2 shows a longitudinal cross-section of subcaliber projectile.
FIG. 3 shows a longitudinal cross-section of an alternate subcaliber projectile.
FIG. 4 is a schematic view of a projectile approaching a target.

Referring now to FIG. 1, the shape and dimensions of the discarding-sabot subcaliber projectile assembly are similar to those of conventional full caliber projectiles. The discarding sabot contains the subcaliber projectile 12 in a coaxial position and consists essentially of three components as described in U.S. Pat. No. 3,714,900. The sabot nose 14 envelops the subcaliber projectile. The rear of the sabot consists of the sabot base 16 provided with a rotating and band 18 preferably manufactured of injection molded plastic as described in my U.S. Pat. No. 3,786,760. The discarding-sabot subcaliber projectile assembly is generally attached to a conventional primed cartridge case 20 containing a propellant 22. Upon firing and emergence from the muzzle of the gun, the sabot components are automatically discarded in a manner described in U.S. Pat. No. 3,714,900 and the subcaliber projectile proceeds along the line of fire at high velocity.

In this application the projectile shown in FIGS. 2 and 3 comprises a main body portion 24 with cylindrical central section 25, tapered nose 26, and tapered base 27 sections. The main projectile body 24 consists of a frangible, high density alloy. The projectile tip 28 is preferably manufactured of a pyrophoric metal such as zirconium alloy, titanium, or depleted uranium alloy. The two components can be assembled by a variety of known methods. In the configuration shown in FIG. 2, assembly is accomplished by means of a press fit at the interface of the nipple-shaped extension 29 of the pyrophoric metal projectile tip and the main projectile body. If desirable, the extension 29 may extend rearward through the entire length of the main projectile body as shown in FIG. 3.

The use of the pyrophoric metal projectile tip is optional and may be omitted as in the case of very small caliber projectiles. In that case the entire subcaliber projectile consists of the high density frangible material as shown in FIG. 1 incorporating the single element subcaliber projectile.

The frangible, high density metal of the subcaliber projectile which is part of this invention provides specific strength properties to enable the desired operation. First of all, the metal has the compressive strength to withstand the longitudinal acceleration experienced by the projectile upon firing from the gun. These accelerations may exceed 175,000 g's for a short duration requiring a compressive strength in excess of 15,000 kg/cm$^2$. At impact on the target the subcaliber projectile experiences an impact shock wave propagated rearward through the projectile. Immediately following the shock-induced compression the material experiences expansion. This expansion results in high tensile loads which lead to the fracturing of the material, a process referred to as spalling. In order to provide the desired projectile fragmentation at comparatively moderate impact shock intensities, such as occur at impact on the aluminum skin of an aircraft at extended engagement ranges and correspondingly reduced projectile velocity, the tensile strength of the projectile material has to be sufficiently low, on the order of 800 kg/cm$^2$.

The fragmentation of a projectile upon impact on an aircraft-type target is illustrated schematically in FIGS. 4 to 6. It is assumed that the projectile, consisting of the main body 24 (frangible, high density alloy and the pyrophoric metal tip 28 shown in FIG. 2, impact on the aluminum skin 30 of an aircraft. Impact occurs at 32 and leaves a hole 34 in the aluminum skin of the aircraft of dimensions slightly larger than those of the projectile. The impact shock fragments the projectile components as illustrated schematically in FIG. 5. Behind the penetrated aluminum skin 30 the random fragments 36 continue their motion with a velocity which is the composite of the residual projectile velocity subsequent to impact and a centrifugal velocity component due to the projectile spin. As a result, an expanding cluster of high speed, high density fragments is formed as indicated by arrows in FIG. 5.

Because of the conical expansion of the fragment cluster, the area of damage incurred by subsequent components of the target (aircraft) increases with distance from the initial impact point 32. This effect is illustrated schematically in FIG. 6 where additional aircraft components 35 and 38 are penetrated by the projectile fragments. In each subsequent penetration; i.e., on plates 38 and 40 of FIG. 6 representing internal aircraft components, further breakup of impacting fragments 36 occurs.

During impact and fragmentation, autoignition of the pyrophoric metal projectile tip occurs. The thus induced exothermic reaction of the metal yields burning temperatures up to 3000° depending on fragment size and fragment velocity. The resultant incendiary effects are of a magnitude to cause ignition of various combustibles such as gasoline and jet fuel (kersosene).

As indicated above, the frangible material of the subcaliber projectile has specific physical and mechanical properties to enable successful operation. First of all, its density should be high, preferably in the range of 17 to 19 g/cm$^3$, to arrive at a high ballistic coefficient for efficient exterior ballistics performance charactertized by short time of flight, flat trajectory and minimum velocity decay. Second, the material has to provide a high dynamic compressive strength to withstand the launch acceleration experienced in the gun. Third, the tensile strength of the material should be low to assure proper projectile fragmentation at reduced impact velocities against thin skinned aircraft structures. The magnitude of the dynamic strength properties depend on the caliber and other specific parameters of the projectile-gun system. As an example, the characteristics for a typical 35 mm discarding-sabot air-defense projectile are listed below:

| | |
|---|---|
| Material density | 15–19 g/cm$^3$ |
| Dynamic strength properties: | |
| compressive | $\delta_c > 15{,}500$ kg/cm$^2$ |
| tensile | $\delta_T > 800$ kg/cm$^2$ |

Of significance are, first of all, the high density of the material; second, the relative weakness in tension as compared to strength in compression with a ratio of compressive strength to tensile strength of approximately 20.

The desired unique properties can be attained using solid state, fusion sintered, commercial grade tungsten. Subsequent to sintering, the material is annealed prior to machining. In this state, the material has a high degree of brittleness and when exposed to an impact shock, as in the case of a projectile hitting a target, will disintegrate into fine fragments. A less thorough fragmentation, i.e., a disintegration into larger particles, can be attained through a lesser degree of annealing of the sintered tungsten prior to machining. Thus, the thoroughness of fragmentation can be controlled, within limits, by the degree of annealing and the related recrystalization of the projectile material.

The sintered unalloyed tungsten materials described above have a density of approximately 19 g/cm$^3$ and their fragmentation characteristics are particularly suited for use in anti-aircraft projectiles ranging in caliber from 12.7 to 40 millimeters.

For larger caliber air-defense ammunition and correspondingly heavier projectiles, a fragmentation into larger particles than described above for the smaller calibers is desired. This is accomplished with an approximately 80% dense sintered tungsten subjected to copper infiltration. The thus obtained copper infiltrated tungsten has a density of 16 g/cm$^3$. Upon impact on an aircraft target, the material disintegrates into randomly shaped fragments having major dimensions from approximately 2 to 8 millimeters.

Other materials besides tungsten may be used according to the present invention, including frangible depleted uranium, having the relative dynamic strength characteristics for compression and tension described above. Materials of lower density, i.e., less than 15 g/cm$^3$, may be used but are less desirable since they sacrifice some of the inherent advantages of high density discarding-sabot ammunition. As an example, steel alloys, with a density of 7.8 g/cm$^3$ would have less desirable exterior ballistic and terminal ballistic performances. Nonetheless, frangible steel alloys having relative strength characteristics for compression and tension described above would be effective against very fast moving targets such as ICBMs where the net impact velocity is very high.

The terminal ballistic mechanism of the frangible tungsten projectile, (see FIG. 6) when employed against an essentially aluminum structure such as an aircraft, includes damage due to fragment impact and penetration, pyrophoric reactions and damage induced by aluminum dust and/or aluminum vapor effects. The latter are due to the vaporization of the aluminum caused by the impacting cluster of high velocity tungsten fragments and the subsequent explosive oxidation of the incandescent aluminum. The extent of the vaporific effects is unique to this type of projectile and is the result of the near total transfer of the kinetic energy of the tungsten fragments to the aluminum target. Being velocity dependent, the magnitude of the terminal effects of the projectile increase with increasing impact velocity.

The kinetic energy of high velocity, high density fragment clusters impacting aircraft fuel tanks induce severe hydraulic shock within the liquid and consequent destruction of the tank. Aluminum vapor explosions and/or burning pyrophoric metal fragments are most effective in igniting the fuel and fuel-air mixtures.

Although consisting of a frangible tungsten alloy, the discarding-sabot, anti-materiel projectile is also effective against hard armor targets, provided that such targets are the first point of impact. If the projectile is fragmented prior to impacting hard armor, for instance by a sheet of aluminum or other metal installed at a distance ahead of the hard armor, its ability to penetrate the hard armor is reduced.

Figure 7:
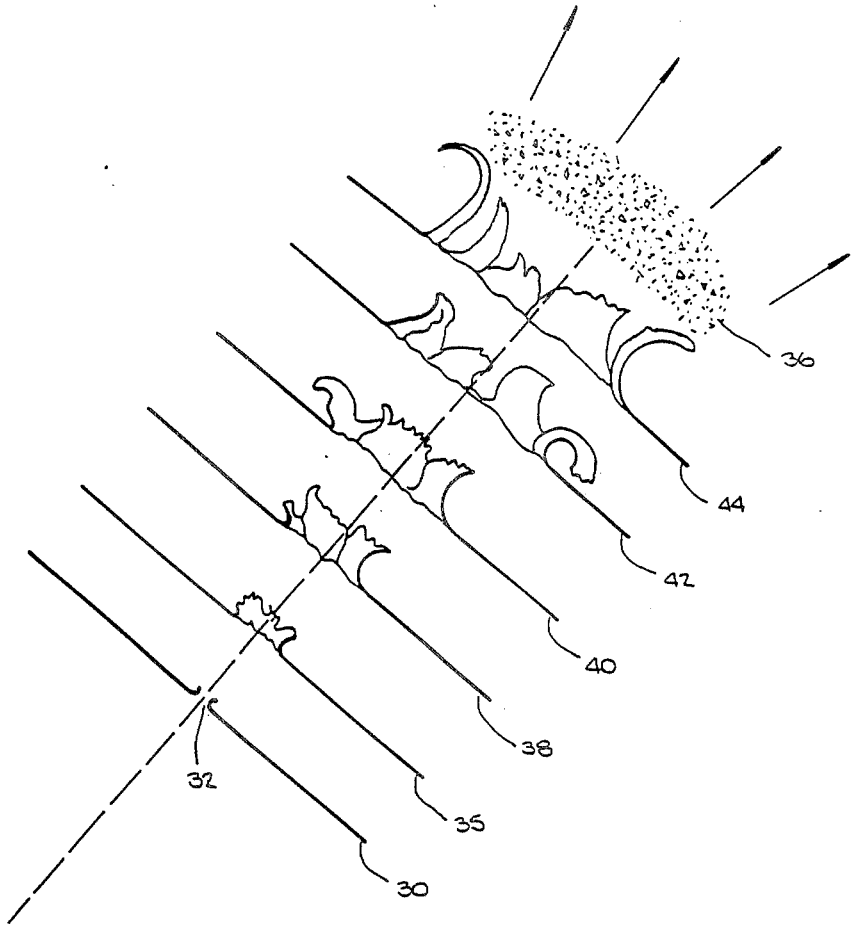
FIG. 7 is a longitudinal section view of a multi-element projectile according to the present invention.

In order to provide improved performance against such multiple plate or spaced armor targets a composite anti-materiel projectile can be used. A longitudinal cross section depicting the major elements of such a subcaliber projectile 41 is shown in FIG. 7. The midsection 42 of the projectile consists of the frangible tungsten alloy described above. The base 44 located at the rear of the projectile is manufactured of a high strength tungsten alloy or equivalent metal commonly used for armor piercing projectiles. To add incendiary effectiveness to the projectile, pyrophoric material such as zirconium or titanium alloy may be used for the projectile tip 46. The use of the pyrophoric material is optional and instead the projectile tip 46 may be an extension of the main projectile body 42 and consist of frangible tungsten alloy.

Figure 8:
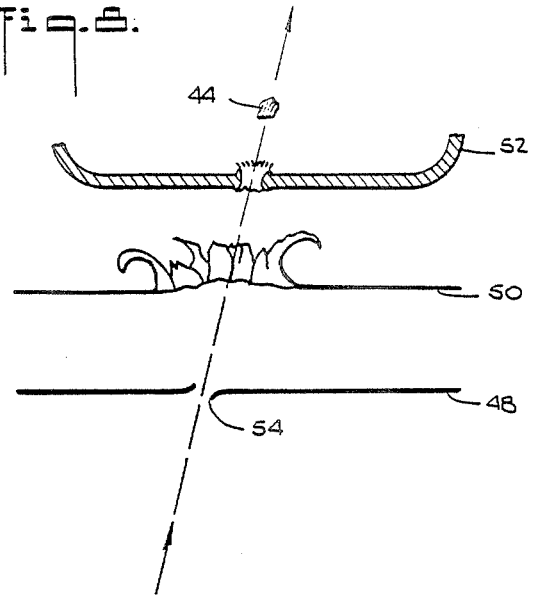
FIG. 8 is a schematic view of a target, such as an aircraft, having several structural members and armor plate penetrated by multi-element projectiles of the present invention.

FIG. 8 illustrates a composite projectile of FIG. 7 hitting a multiple plate target. The target includes outer aluminum plates 48 and 50 and an inner armor plate 52. Upon impact of projectile 41 at point 54 of outer plate 48, the frangible main projectile body 42 and tip 46 fragment into pieces 56 in the manner described above in connection with FIGS. 4–6. The base 44 of the projectile will remain essentially undeformed and act as an armor-piercing projectile capable of penetrating high strength steel or armored plate 52 within the aircraft structure.

Figure 9:
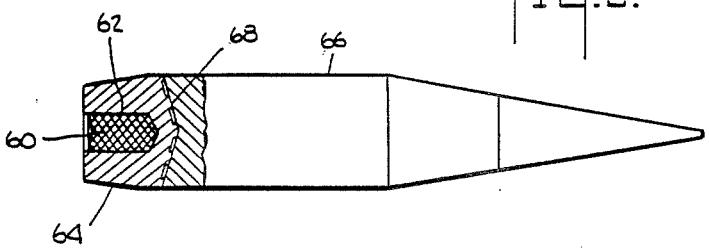
FIG. 9 is a longitudinal section view of a projectile according to the present invention containing a tracer.

A projectile according to the present invention may include a conventional pyrophoric tracer 60 installed at its base as shown in FIG. 9. However, in the case of a spin stabilized, discarding-sabot projectile, as illustrated in FIG. 1, where the accelerating forces during launch are transmitted to the base of the projectile, the area surrounding the tracer cavity has to be reinforced. The presence of the tracer cavity 62 results in substantial shear forces during launch acceleration which exceed the strength properties of the frangible material. A material combining the properties described earlier has a characteristically low notch sensitivity. Hence, the projectile portion containing the tracer cavity 64 has to consist of a stronger material such as a conventional tungsten alloy, or equivalent. The selection of a high strength tungsten alloy has the advantage that the thus reinforced projectile portion 64 can be attached to the forward portion 66 of the projectile by brazing at the common interface 68. The geometric shape of the interface 68 is not critical provided that it does not impose excessive shear loads into the projectile body portion 66 consisting of the frangible material.

High explosive projectiles, commonly used against enemy aircraft, are frequently equipped with a self-destruct device. In most cases self-destruct is the final function of the projectile-borne fuze and is initiated at a certain time of flight corresponding to a range in excess of the effective range of the ammunition. The objective of the self-destruct device is the destruction of projectiles which did not intercept the intended target prior to their impact on friendly soil.

A frangible projectile according to this convention has the advantage of requiring neither a fuze nor high explosive filler for its operation. In order to provide a self-destruct feature, the pyrophoric tracer 60 is used as a timer to initiate the break-up of the projectile as shown in FIG. 10. Break-up is induced by a primer pellet 72 located at the end of the tracer cavity 62. The primer pellet 72 is ignited by the pyrophoric tracer 60 at the end of its burning cycle. The pressure pulse resulting from the combustion of the primer pellet is sufficient to induce the break-up of the frangible projectile body which is already in a prestressed condition due to the spinning motion of the projectile. Subsequent to break-up, the resultant fragments are dispersed and are decelerated by aerodynamic drag to a degree where they cease to be a hazard.

I claim:

1. A discarding sabot subcaliber projectile comprising a frangible projectile body made from sintered unalloyed tungsten material having a density of about 17 to about 19 g/cm$^3$, a compressive strength of at least 15,000 kg/cm$^2$, and a ratio of compressive strength to tensile strength of approximately 20:1.

2. A spin-stabilized, discarding sabot subcaliber projectile suitable for use against aircraft structures having components containing aluminum or titanium comprising a frangible projectile body made from sintered unalloyed tungsten material having a density of about 17 to about 19 g/cm$^3$, a compressive strength of at least 15,000 kg/cm$^2$, and a ratio of compressive strength to tensile strength of approximately 20:1, the destructive effectiveness of said projectile resulting from damage inflicted by the residual kinetic energy of an expanding cluster of high density fragments formed by thorough fragmentation of the frangible projectile body upon impact with said structure, and from the explosive oxidation of aluminum or titanium dust or vapor formed by the impact of said fragments with said components.

3. A projectile as in claims 1 or 2 wherein the sintered unalloyed tungsten material is copper infiltrated.

4. A projectile as in claims 1 or 2 wherein said projectile has a pyrophoric wind screen.

5. A projectile as in claims 1 or 2 wherein the frangible projectile body has a tensile strength on the order of 800 kg/cm$^2$.

6. A projectile as in claims 1 or 2 wherein the frangible projectile body is capable of fragmenting into particles having major dimensions less than from approximately 2 to about 8 millimeters.

7. A projectile as in claim 2 wherein said fragments are capable of further breakup upon impact with said components.

8. A method for substantially damaging aircraft structures having components containing aluminum or titanium comprising:

impacting the aircraft structure with a high velocity discarding sabot subcaliber projectile having a frangible projectile body made from sintered unalloyed tungsten material having a density of about 17 to about 19 g/cm$^3$, a compressive strength of at least 15,000 kg/cm$^2$, and a ratio of compressive strength to tensile strength of approximately 20:1; and fragmenting the frangible projectile body into an expanding cluster of high velocity, high density fragments formed by thorough fragmentation of the frangible projectile body upon impact with said structure, said fragments further damaging said structure by impacting and penetrating said components to form sufficient amounts of aluminum or titanium dust or vapor to cause explosive oxidation to occur.

9. A projectile as in claim 3 wherein the frangible projectile body is capable of fragmenting into particles having major dimensions of about 2 mm to about 8 mm.

10. A spin-stabilized discarding sabot projectile comprising a frangible core fabricated of tungsten having a density of 16 to 19 g/cm$^3$, the core having a high degree of brittleness, a sufficient compressive strength to withstand longitudinal acceleration forces during launch from a gun tube and a low tensile strength to undergo instantaneous and thorough disintegration induced by the comparatively moderate impact shock intensities as occur at impact on the thin skin of an aircraft target at extended engagement ranges and correspondingly reduced projectile velocities, the core disintegration constituting a nearly uniform expanding cluster of high velocity, high density fragments including fine fragments and fragments of a less thorough fragmentation of 2 to 8 cm, with damage to the target being imparted through impact and penetration of the high velocity fragments resulting in the formation and explosive oxidation of metallic dust and resulting over pressures, and with the area of damage incurred by subsequent components of the target increasing with distance from the initial impact point.

11. A projectile according to claim 10 in which the core is made of sintered unalloyed tungsten having a density of about 17 to about 19 g/cm$^3$, a compressive strength of at least 15,000 kg/cm$^2$, and a ratio of compressive strength to tensile strength of approximately 20:1.

12. A spin-stabilized discarding sabot projectile for use against aircraft structures having aluminum or titanium components comprising a frangible core fabricated of sintered unalloyed tungsten having a density of about 19 g/cm$^3$, the core having a high degree of brittleness, a sufficient compressive strength to withstand longitudinal acceleration forces during launch from a gun tube and a tensile strength on the order of 800 g/cm$^3$ to undergo instantaneous and thorough disintegration induced by the comparatively moderate impact shock intensities as occur at impact on the thin skin of an aircraft target at extended engagement ranges and correspondingly reduced projectile velocities, the core disintegration constituting a nearly uniform expanding cluster of high velocity, high density fragments including fine fragments and fragments of a less thorough fragmentation of 2 to 8 cm, with damage to the target being inflicted by the residual kinetic energy of the high velocity fragments hitting and penetrating the target, by the formation and explosive oxidation of aluminum or titanium dust or vapor resulting from fragment impact and resulting overpressures, and with the area of damage incurred by subsequent components of the target increasing with distance from the initial impact point.

13. A projectile as in claim 10 wherein the core is copper infiltrated unalloyed tungsten.

14. A projectile as in claim 10 wherein said projectile has a pyrophoric wind screen.

15. A projectile as in claim 12 wherein said projectile has a pyrophoric wind screen.

16. A projectile as in claim 10 wherein the frangible projectile body has a tensile strength on the order of 800 kg/cm2.

17. A method for substantially damaging aircraft structures having components containing aluminum or titanium comprising: hitting the aircraft structure with a high velocity discarding sabot subcaliber projectile having a density of 16 to 19 g/cm$^3$, the projectile having a high degree of brittleness, a sufficient compressive strength to withstand longitudinal acceleration forces during launch from a gun tube and a low tensile strength to undergo instantaneous and thorough disintegration induced by the comparatively moderate impact shock intensities as occur at impact on the skin of an aircraft target at extended engagement ranges and correspondingly reduced projectile velocities; and fragmenting the frangible projectile body into a nearly uniform expanding cluster of high velocity, high density fragments including fine fragments and fragments of a less thorough fragmentation of 2 to 8 cm, with damage to the structure being imparted through impact and penetration of the high velocity fragments resulting in the formation and explosive oxidation of aluminum or titanium dust or vapor and resulting overpressures, and with the area of damage incurred by subsequent components of the structure increasing with distance from the initial impact point.

* * * * *